US008458938B2

(12) United States Patent
Tucker et al.

(10) Patent No.: US 8,458,938 B2
(45) Date of Patent: Jun. 11, 2013

(54) SELF-CONTAINED ILLUMINATED BUS SIGNAL

(76) Inventors: Aaron J. Tucker, Stafford, VA (US); Khadijah Nashid-Tucker, Stafford, VA (US)

( * ) Notice: Subject to any disclaimer, the term of this patent is extended or adjusted under 35 U.S.C. 154(b) by 1426 days.

(21) Appl. No.: 11/676,496

(22) Filed: Feb. 19, 2007

(65) Prior Publication Data

US 2007/0209260 A1 Sep. 13, 2007

Related U.S. Application Data

(60) Provisional application No. 60/774,628, filed on Feb. 21, 2006.

(51) Int. Cl.
*G09F 15/00* (2006.01)

(52) U.S. Cl.
USPC ..... 40/607.1; 40/564

(58) Field of Classification Search
USPC ..... 40/607.01
See application file for complete search history.

(56) References Cited

U.S. PATENT DOCUMENTS

| | | | | |
|---|---|---|---|---|
| 2,432,928 | A * | 12/1947 | Palmquist | 40/615 |
| 3,963,202 | A | 6/1976 | Hopkins | |
| 4,042,919 | A | 8/1977 | Patty | |
| 4,108,405 | A | 8/1978 | Gibson | |
| 4,200,904 | A | 4/1980 | Doan | |
| 4,449,170 | A * | 5/1984 | Warshawsky | 362/413 |
| 4,489,306 | A | 12/1984 | Scolari | |
| 5,021,780 | A | 6/1991 | Fabiano et al. | |
| 5,819,455 | A | 10/1998 | Tsuda | |
| 6,131,321 | A | 10/2000 | Daigle, Jr. | |
| 6,158,379 | A | 12/2000 | Burlando | |
| 6,233,898 | B1 | 5/2001 | Burlando | |
| 6,522,263 | B2 | 2/2003 | Jones | |
| 6,577,072 | B2 | 6/2003 | Saito et al. | |
| 6,621,177 | B2 * | 9/2003 | Westcott | 307/10.1 |
| 6,943,698 | B2 | 9/2005 | Jones et al. | |
| 6,968,640 | B2 | 11/2005 | Lee | |
| 6,976,329 | B1 | 12/2005 | Foster | |
| 2002/0099500 | A1 | 7/2002 | Schmier et al. | |
| 2004/0076013 | A1 | 4/2004 | Tseng | |
| 2006/0139156 | A1 | 6/2006 | Beverly | |
| 2006/0220807 | A1 | 10/2006 | Thompson | |
| 2006/0226964 | A1 | 10/2006 | Riesebosch | |
| 2007/0001872 | A1 | 1/2007 | Ellison | |

FOREIGN PATENT DOCUMENTS

WO WO 2004/029919 * 4/2004

* cited by examiner

*Primary Examiner* — Joanne Silbermann
*Assistant Examiner* — Kristina Junge
(74) *Attorney, Agent, or Firm* — Clyde I. Coughenour

(57) ABSTRACT

A bus stop sign and notification device is powered by an electric circuit that includes a solar panel and battery mounted in a battery box on a bus shelter or vertical support pole. The vertical support secures first and second signs and first and second illuminators for information dissemination and visual attraction. Long lasting light-emitting diodes in various colors are mounted on an adjustable or swivel hood that is used to aim the lights. The lights can include a flashing strobe light for attracting the attention of a bus driver at a distance. A reflector shield on the pole can protect wires and reflect different color light when the sign is illuminated and attract attention to the sign at night. The illuminators are activated by a button switch by bus passengers for reading the signs and notifying a driver to stop for passengers.

15 Claims, 1 Drawing Sheet

SELF-CONTAINED ILLUMINATED BUS SIGNAL

PRIORITY DATA

Priority of U.S. Provisional Application No. 60/774,628, filed Feb. 21, 2006 is hereby claimed.

BACKGROUND OF THE INVENTION

1. Field of the Invention

The invention is to a bus stop sign and attention getter having self-contained solar powered, selective useable illumination for information dissemination and bus driver notification.

2. Description of Related Art

The prior art is crowded with roadside signs that include solar-powered illumination. Examples include P. Gibson (U.S. Pat. No. 4,108,405, issued Aug. 22, 1978) and D. Doan (U.S. Pat. No. 4,200,904, issued Apr. 29, 1980) and W. Daigle, Jr. (U.S. Pat. No. 6,131,321, issued Oct. 17, 2000) and R. Jones (U.S. Pat. No. 6,522,263, issued Feb. 18, 2003) and K. Lee (U.S. Pat. No. 6,968,640, issued Nov. 29, 2005) and C. Tseng (U.S. Publication No. 2004/0076013 A1, published Apr. 22, 2004), and C. Beverly (U.S. Publication No. 2006/0139156 A1, published Jun. 29, 2006).

The providing of a "u" shape sign support or post with a reflective cover is disclosed by A. Burlando (U.S. Pat. No. 6,158,379, issued Dec. 12, 2000) and A. Burlando (U.S. Pat. No. 6,233,898, issued May 22, 2001).

D. Jones et al (U.S. Pat. No. 6,943,698, issued Sep. 13, 2005) disclose a traffic control sign with LED attraction. R. Patty (U.S. Pat. No. 4,042,919, issued Aug. 16, 1977) teaches an illuminated sign with on/off switch for an intermittently activating a strobe light and illumination light. C. Tseng (U.S. 2004/0076013, published Apr. 22, 2004) teaches an illuminated door plate using a solar panel, battery and control.

SUMMARY OF THE INVENTION

The invention is to a bus stop sign. Two primary signs are supported by a vertical support or bus shelter. One sign lists bus schedules and the other select information. The second sign, preferably in more than one language and brail, gives instructions on use of the sign illumination. The sign can be illuminated by pressing on a button or switch to read sign information and/or to notify an oncoming bus driver to stop because passengers are waiting. The illumination is by various light sources powered by a solar panel battery combination activated by a manually ADA pressed switch or button. A reflector is positioned on the support for calling attention to the bus stop at night or during inclement weather. 28 29

DESCRIPTION OF THE PREFERRED EMBODIMENTS

Figure 1:
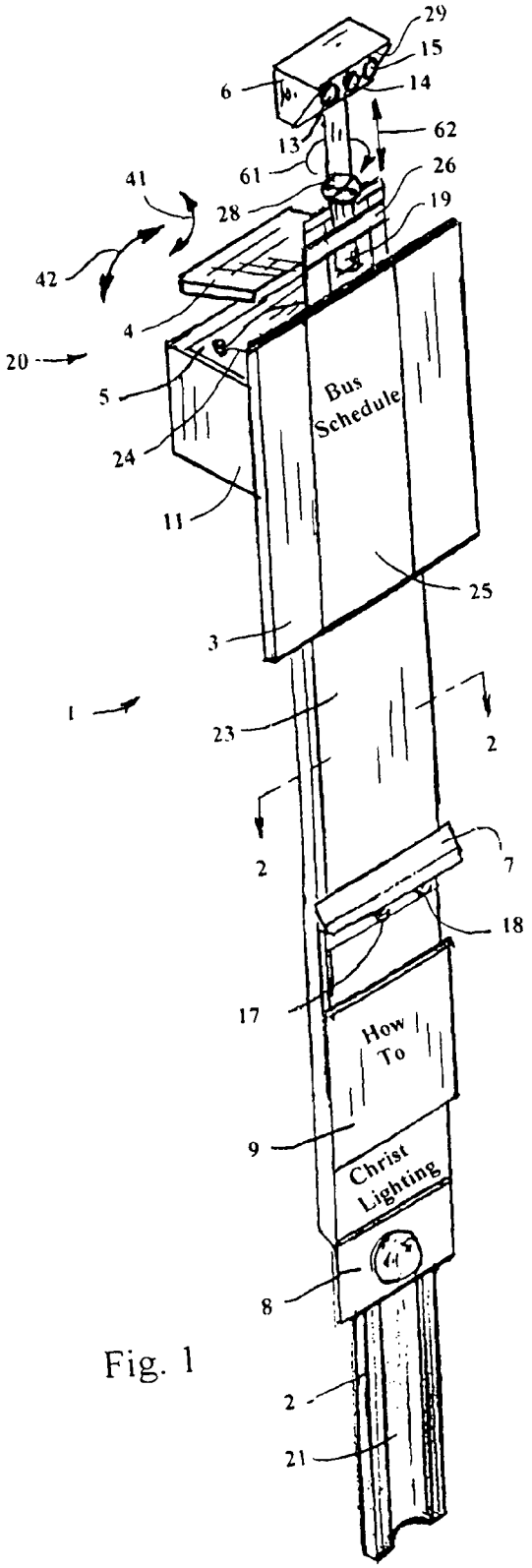
FIG. 1 is a perspective view of the bus stop sign of the invention.
Figure 2:
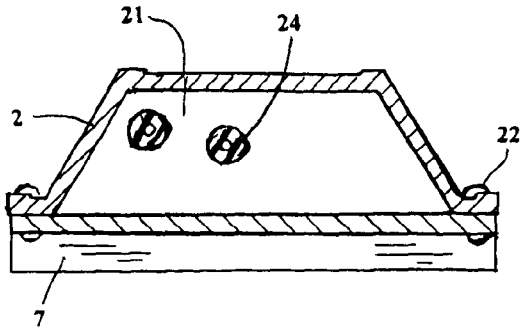
FIG. 2 is a sectional view along the section line 2-2 of FIG. 1
Figure 3:
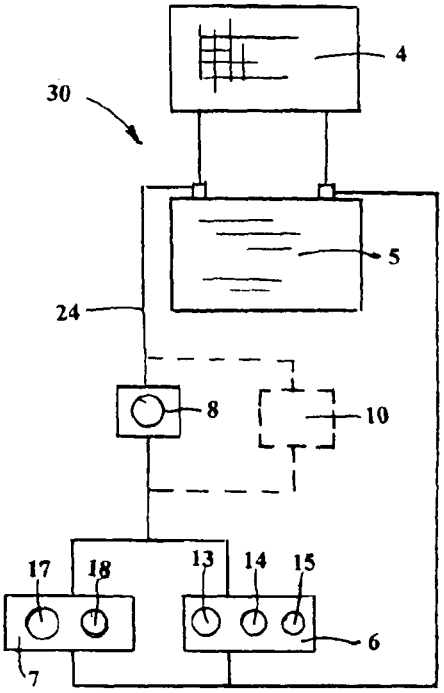
FIG. 3 is a simplified block diagram of the electric circuit of the invention.

A bus stop sign and attention getter 1 is used by passengers for information dissemination.

The primary support for the sign panel can be a bus shelter but is preferably a "u" shape pole 2 having its lower end supported by or imbedded in the ground or a solid surface. The upper end can support or house an adjustable or swivel hood 6. The hood can be on a pipe 19 or other generally vertical stanchion attached to the vertical support. The hood can be rotated or pivoted 61 to aim it in the direction illumination is desired. The pipe can be raised or lowered 62 in the support 2 or moved. The open side of the support is covered in part or totally by one or more signs 3, 9, a reflector panel 23, an illumination device and shield 7 and an illuminator switch 8. Along the length of the primary support 2 the wiring 24 for illumination is enclosed and protected within the recessed area 21 of the support 2 by the signs and reflector. An electrical supply combination 20 is also supported by the upper end of the primary support. A reflective tape 25 can extend over the sign above the reflector shield and under indicia to enhance visibility of the bus stop sign 1 and its sign panel 3.

The electric energy for the sign and bus driver notification illumination 6 is provided by a solar panel 9 and battery pack 5, 11. A battery box 11 has an inner side secured to the upper end of the primary "u" support 2. The battery box inner side can be secured so as to be rotatable around the support. A battery 5 can be placed in and locked into the battery box 11. A solar panel 4 can be pivotally secured to the upper battery box outer side. The solar panel can be pivoted in the vertical plane 41 and in the horizontal plane 42 so that it can be faced toward the sun. The solar panel 4 is used to charge the battery 5 and the battery is used to supply electricity to the illuminators under control of a manually operated switch 8.

To be effective during all conditions, an illumination swivel hood 6 is provided. The hood can be supported by a pipe 19 that is rotated 61 and raised or lowered 62 within the "u" shape primary support upper end so as to selectively face oncoming traffic and illuminate any sign and other article secured to the support. The hood houses illuminators for the sign that can be varied to include a white 13 and red or blue or green LED 14 for attracting attention to the sign. A flashing strobe light 15 can be included as an attention getter from a distance to identify and alert the bus driver that passengers are waiting at the stop. The color light(s) reflects off the reflectors 23, 25 adding to the attention-getting effect. The inner upper hood 29 can be painted white or have some other reflective surface to assist lighting the signs(s). The hood 6 pipe support 19 lower extent is shown housed within the "u" shape pole 2 upper end by a strap 26. In the event it is desired to place the sign on a shelter or other support, the pipe 19 and hood 6 can be removed and positioned on an adjacent support. To accommodate alinement of the hood with oncoming traffic when removed from the pole 2 a universal joint 28 is provided in the pipe.

A driver alert sign 9 can be placed near the mid to lower extent of the primary support. The alert sign 9 provides information about sign operation in several languages such as English, Spanish and braille. The sign is provided with a light that can be used for reading the information on the sign 9 during dark or inclement weather. The button or switch 8 is provided for actuating the light for this purpose as well as for alerting the bus driver to stop.

The lights in housing shield 7 are primarily for illuminating the sign 9 and are white lights 17, 18. The lights in housing hood 6 perform the dual purpose of illuminating the sign 3 and notifying the bus driver that a passenger is waiting to be picked up. For this reason it is preferred that a "white" light 13 be provided in the hood with a flashing strobe light 15 and/or one or more L.E.D. color lights 14. The lights, and in particular the color light(s), illuminate the sign and reflector(s) to enhance visibility and aesthetics.

The solar panel can be composed of a single 1.26 W solar module that is about 7 inches in length, 6 inches in width and ¼ inch thick, having a weight of about 5 ounces. The panel array, when connected to the charging circuitry, can provide enough solar power to operate the system for years.

The preferred box 11 and battery 5 used can vary. The battery used can be a 12-volt battery. It can be a sealed lead acid rechargeable battery having an excellent temperature performance and very long life. Its length can be 6 and ⅛ inches, with a width of 6 and ⅝ inches, and a weight of 9 pounds. It is stored in a custom made galvanized lock box. The box can have a length of 6 and ½ inches, with a width of 6 and ⅞ inches and a weight of 8 ounces.

As to the swivel hood 6, the hood can be made of a galvanized sheet metal. The hood length can be 4-6 inches with a height of 2-4 inches and a weight of about 5 ounces. The support pipe 19 can be a Condor pipe. This ½ inch galvanized metal pipe can enclose the wiring, protecting it from the weather and vandalism, and can be used as an extension for the Swivel Hood.

As to the illuminators, it is preferred that the high-powered L.E.D. utility reading light can be used. Its length can be about 2 inches with a width of about 1 and ⅛ inches and a weight of about 1 ounce.

The tamper resistant reflection shield 23 can be made of galvanized sheet metal. It is about 3 inches in width, the length can be about 5 inches and it can be ¼ inch thick with a weight of about 1 pound.

As to the switch 8, an ADA heavy-duty tension switch with a 2 inch mushroom plunger is preferred. It can have a 4 and ½ inch length with a 2 and ½ inch width and can weigh about 1 pound.

The electrical circuitry 30 is quite simple. The solar panel 4 provides a charge for the battery 5. The battery is used to power the illumination devices for viewing the information panel 9 and sign 3 as well as for notifying the bus driver that a stop is to be made to pick up passengers. Because of the large amount of time the device 1 is not in use, the only time illumination is necessary is when a rider needs to review the bus schedule or board a bus. In view of this, the illumination devices are both activated simultaneously. The positioning of the switch 8 is such that the switch can be pushed and the signs observed at the same time by most people. The illumination can be limited to the actual time the passenger pushes on the switch or button 8. As an optional alternative, a timing device 10 can be installed in the circuit so that pushing the switch activates the lights for a time certain, such as for 5 to 30 seconds. This is usually enough time for the signs to be read and/or the bus driver to observe that a passenger is waiting. In the event it is not, the switch can be pressed a second time. The switch precludes the need for passengers to expose themselves to traffic for flagging down a bus and precludes unnecessary stops by bus drivers.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A bus stop sign and signal device comprising:
a vertical support;
a first sign on said vertical support;
a battery housing on said vertical support for housing a battery;
a battery in said battery housing;
a first illumination means in a housing supported by said vertical support above said first sign;
said first illumination means having a first light in said housing for illuminating said first sign and a second light in said same housing for notifying an approaching bus driver to stop at the bus stop;
a switch for activating said first illumination means;
said vertical support is a post;
said first illuminating means is in a housing positioned at an upper end of said post and said housing is in the form of a hood;
said hood is adjustable to align the direction said first illumination means is pointed in for both illumination of said first sign and notification to said bus driver to stop;
a second sign on said vertical support;
a second illumination means supported on said vertical support;
said second illumination means having a first light positioned to illuminate said second sign;
said switch for activating said first illumination means also activates said second illumination means to simultaneously illuminate said first sign and said second sign and to notify said bus driver to stop.

2. A bus stop sign and signal device as in claim 1 wherein:
said vertical support is a post;
said post is in a "u" shape;
said "u" shape post has a recessed area that is enclosed by a panel that extends along a portion of said "u" shape post;
wiring extends from said battery to said second illumination means;
said wiring extends through said "u" shape post recessed area between said "u" shape post and said panel where said wires are protected.

3. A bus stop sign and signal device as in claim 1 including:
a reflective tape on said first sign for attracting attention to said first sign at night and during inclement weather;
said reflected tape being illuminated by light from said first illumination means first light and by oncoming traffic.

4. A bus stop sign and signal device as in claim 3 wherein:
said vertical support is a post;
said post is in a "u" shape;
said "u" shape post has a recessed area that is enclosed by a reflecting panel that extends along a portion of said "u" shape post.

5. A bus stop sign and signal device as in claim 4 wherein:
wiring extends from said battery to said second illumination means;
said wiring extends through said "u" shape post recessed area between said "u" shape post and said reflecting panel where said wires are protected.

6. A bus stop sign and signal device comprising:
a vertical support;
a first sign on said vertical support;
a battery housing on said vertical support for housing a battery;
a battery in said battery housing;
a first illumination means in a housing supported by said vertical support above said first sign;
said first illumination means having a first light in said housing for illuminating said first sign and a second light in said same housing for notifying an approaching bus driver to stop at the bus stop;
a switch for activating said first illumination means;

said vertical support is a post;

said first illuminating means is in a housing positioned at an upper end of said post and said housing is in the form of a hood;

said hood is adjustable to align the direction said first illumination means is pointed in for both illumination of said first sign and notification to said bus driver to stop;

said hood is elevated above said vertical support on a pipe that is vertically adjustable in said vertical support and is rotatable in said vertical support for adjusting the direction light coming from said first illumination means is pointed in;

said pipe includes a universal joint for independent adjustment.

7. A bus stop sign and signal device comprising:

an elongated vertical support;

a first sign having bus schedule and other information on said elongated vertical support;

a second sign having instructions for bus passengers on said elongated vertical support;

a first illumination means and a second illumination means on said elongated vertical support for illuminating said first sign and said second sign respectively;

a hood supported by said elongated vertical support;

said first illumination means includes a first light in said hood for illuminating said first sign and a second light for notifying a bus driver to stop at said bus stop;

said second illumination means including a first "white" light in a shield for illuminating said second sign;

a manually operated switch for activating said first illumination means first light and second light and said second illumination means first light;

an electric circuit for said first illumination means and for said second illumination means;

said electric circuit limits activation of said first illumination means and said second illumination means to a time certain to conserve electricity.

8. A bus stop sign and signal device as in claim 7 wherein:

said first illumination means first light is a white light and said second light is a strobe light and includes a third light that is an LED light that is a color other than "white" for attracting attention.

9. A bus stop sign and signal device as in claim 7 wherein:

said hood is elevated above said elongated vertical support on a pipe that is vertically adjustable in said vertical support and is rotatable in said vertical support for adjusting the direction light coming from said first illumination means is pointed in;

said pipe includes a universal joint for independent adjustment.

10. A bus stop sign and signal device as in claim 7 including:

a battery housing on said elongated vertical support for a battery;

a battery in said battery housing;

a solar panel for converting light into electricity for charging said battery;

said battery housing has an inner side and an outer side;

said battery housing inner side is attached to said vertical support;

said solar panel is attached to said battery housing outer side so as pivot in a vertical plane and rotate in a horizontal plane for aligning said solar panel with the sun as the seasons and surrounding conditions change.

11. A bus stop sign and signal device as in claim 7 wherein:

said vertical support is a post;

said post is in a "u" shape;

said "u" shape post has a recessed area that is enclosed by a reflecting panel that extends along a portion of said "u" shape post;

wiring extends from said battery to said second illumination means;

said wiring extends through said "u" shape post recessed area between said "u" shape post and said reflecting panel where said wires are protected.

12. A bus stop sign and signal device comprising:

a vertical support;

a first sign on said vertical support;

a reflective tape on said first sign for attracting attention to said first sign at night and during inclement weather;

said vertical support is a post;

said post is in a "u" shape;

said "u" shape post has a recessed area that is enclosed by a reflecting panel that extends along a portion of said "u" shape post;

a battery housing on said vertical support for housing a battery;

a battery in said battery housing;

wiring extends from said battery;

said wiring extends through said "u" shape post recessed area between said "u" shape post and said reflecting panel where said wires are protected;

a first illumination means supported by said vertical support above said first sign and above said reflective tape and above said reflecting panel;

said first illumination means having a first light for illuminating said first sign and said reflective tape and said reflective panel;

said first illumination means having a second light for notifying an approaching bus driver to stop at the bus stop;

a switch for activating said first illumination means said first light and said second light;

said first illumination means positioned above said first sign and said reflector tape and said reflecting panel illuminates said first sign and said reflective tape on said first sign and said reflective panel covering said open side of said "u" shaped post when said switch is activated.

13. A bus stop sign and signal device as in claim 12 wherein:

said first illuminating means is in a housing;

said housing is positioned at an upper end of said post and said housing is in the form of a hood;

said hood is adjustable to align the direction said first illumination means is pointed in for both illumination of said first sign and notification to said bus driver to stop.

14. A bus stop sign and signal device as in claim 13 wherein:

said hood adjustment includes a pipe support vertically slidable and rotatable within said vertical support post.

15. A bus stop sign and signal device as in claim 12 wherein:

said first illumination means is housed in a hood on said vertical support above said first sign;

said hood first illumination means first light is white for illuminating said first sign and said first illumination means second light is a strobe light for bus driver notification and a third light in said hood is a non-white LED light for attracting attention.

* * * * *